United States Patent [19]

Flatau

[11] Patent Number: 4,612,860

[45] Date of Patent: Sep. 23, 1986

[54] PROJECTILE

[76] Inventor: Abraham Flatau, 2004 Stockton Rd., Joppa, Md. 21085

[21] Appl. No.: 743,879

[22] Filed: Jun. 12, 1985

Related U.S. Application Data

[63] Continuation of Ser. No. 627,142, Jul. 2, 1984, abandoned.

[51] Int. Cl.[4] ..... F42B 11/06

[52] U.S. Cl. ..... 102/518; 102/364; 102/501

[58] Field of Search ..... 102/514–519, 102/501, 364

[56] References Cited

U.S. PATENT DOCUMENTS

| | | | |
|---|---|---|---|
| 911,591 | 2/1909 | Hoxie | 102/518 |
| 3,880,083 | 4/1975 | Wasserman et al. | 102/519 |
| 4,075,946 | 2/1978 | Reffayet et al. | 102/518 |
| 4,353,302 | 10/1982 | Strandli et al. | 102/518 |
| 4,384,528 | 5/1983 | Moore | 102/519 |
| 4,444,112 | 4/1984 | Strandli et al. | 102/518 |

FOREIGN PATENT DOCUMENTS

| | | | |
|---|---|---|---|
| 866323 | 7/1941 | France | 102/518 |

*Primary Examiner*—Harold J. Tudor

*Attorney, Agent, or Firm*—Anthony T. Lane; Robert P. Gibson; Edward F. Costigan

[57] ABSTRACT

An armor piercing projectile having a carrier body and a rod-type high density penetrator core. The leading edge portion of the carrier body is beveled and extends beyond the nose of the penetrator core. Encompassing the carrier body is a nose shape to provide relatively low aerodynamic drag during flight. The carrier body is designed to allow the projectile to be spin stabilized when fired from a suitable weapon.

1 Claim, 10 Drawing Figures

PROJECTILE

GOVERNMENT RIGHTS

The invention described herein may be manufactured, used and licensed by the Government for governmental purposes without the payment to me of any royalties thereon.

This application is a continuation of Ser. No. 627,142 filed on July 2, 1984, now abandoned.

BACKGROUND OF THE INVENTION

1. Field of the Invention

The invention relates to projectiles, and more specifically to armor penetrating projectiles which contain therein high density rod penetrator cores.

2. Brief Description of the Prior Art

Heretofore, two types of armor piercing projectiles were utilized. The earlier designs were of a conventional projectile shape and were full-bore diameter, consisting of a lightweight material in the nose section and a hardened steel or high density material core behind the nose section forming the remainder of the projectile. This type of projectile had limited armor penetration capability. More recently it has been demonstrated that rod type penetrators fabricated of high density material are capable of penetrating more armor than the full-bore design. To take advantage of the rod's high ballistic coefficient and to provide increased initial launch velocities, sabots were designed to encapsulate the rod penetrator during handling, storage, and gun firing, and to discard shortly after exiting the muzzle, thus allowing only the rod penetrator to continue in flight toward the target. The sabot discard process can introduce trajectory inaccuracies for the rod projectile, as well as representing a mass-energy loss.

On the other hand, current full-bore projectiles utilize only the high density core for armor penetration. Accordingly, it would be advantageous to provide a full-bore projectile wherein each major material component of the projectile contributes significantly to an increased penetration capability.

SUMMARY OF THE INVENTION

It is an object of the invention to provide an armor piercing projectile which overcomes the problems set forth in detail herein above by retaining all of the in-bore projectile components, and which are designed to contribute to the process of target penetration.

The projectile assembly of this invention is made up of a full bore cylindrical carrier body with an open center section and closed base. The forward portion of the carrier body has a sharp tapered beveled leading edge. The carrier body also has suitable means to engage the rifled barrel and to transmit the rotational torque required for in-flight stability. A high density rod penetrator core having a tapered front portion is press fit into the carrier. A thin plastic or aluminum windshield or nose fits over the outside tapered portion of the carrier body to improve the aerodynamic drag qualities of the projectile.

Unlike the present series of Armor Piercing Discarding Sabot (APDS) projectiles, the entire armor piercing projectile of this invention is designed to remain integral when fired from a gun. Retaining the rod carrier body and designing it to be utilized to initiate the penetration process prior to the impact of the rod core has heretofore never been undertaken and successfully achieved.

It is therefore an object of this invention to provide an armor piercing projectile which incorporates therein a high density rod penetrator core.

It is still another object of this invention to provide an armor piercing projectile which incorporates a carrier body for the high density rod penetrator core having a sharp beveled leading edge.

These and other objects of the invention will be better understood by reference to the following detailed descriptions, accompanying drawings, and appended claim.

BRIEF DESCRIPTION OF THE DRAWINGS

The specification concludes with a claim particularly pointing out and distinctly claiming the subject matter of the present invention. However, it is believed that the invention will be better understood from the following description taken in connection with the accompanying drawings in which:

DESCRIPTION OF THE PREFERRED EMBODIMENTS

Figure 1:
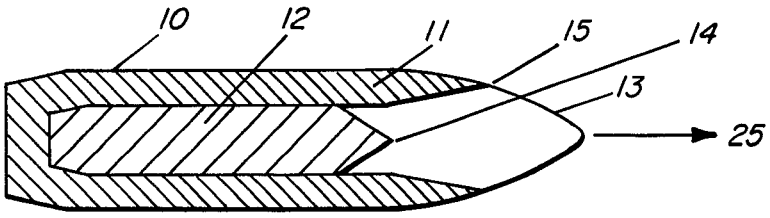
FIG. 1 is a cross-sectional view of one embodiment of this invention.
Figure 6:
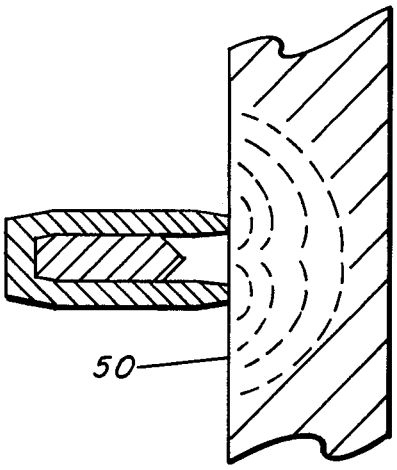
FIG. 6 is a longitudinal view schematically illustrating the initiation of the penetration process as the projectile of this invention impacts the target.
Figure 10:
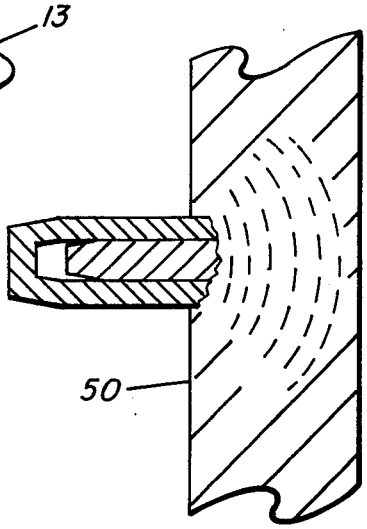
FIG. 10 is a longitudinal view illustrating the initiation of the penetration process as the current non-saboted high density core projectile impacts the target.

As shown in FIG. 1, a full-caliber projectile according to the present invention may have an outward shape and symmetry very similar to those of conventional projectiles, providing an advantage not heretofore obtained with discarding sabot projectiles. Major components or parts of this new projectile 10 include elongate carrier 11, which may be made of steel, the elongate rod penetrator core 12, made of high density material such as tungsten alloy or depleted uranium, and a thin ogival nose shield 13 attached to the forward end of the carrier 11. The nose shield may be made of plastic or aluminum, but in any case is preferably light in weight. It will be noted in FIG. 1 that the nose portion 14 of the rod penetrator core 12 is not aligned in a vertical plane with the beveled leading edge 15 of the carrier 11. Rather, the core nose 14 is deliberately placed aft or behind the leading edge 15 of carrier 11 with reference to the travel direction 25 of projectile 10. This relative positioning is done to produce the following sequence of events and is based on the phenomena of interaction between projectile 10 and the surface of impact. Upon target impact, the sharp, annular beveled leading edge 15 of the carrier 11 produces a stress field in the target 50 as shown in FIG. 6. As the stress waves meet in the target material, they combine and result in a wave amplitude increase (FIG. 6) which is significantly larger than that produced by the conventional armor piercing projectile (FIG. 10) This stress field in the target material is then further increased or reinforced by the rod core 12 at the center impacting the target shortly after the initial impact by the sharp leading edges 15 of the outer structure. The target material cannot resist the sudden or rapid stress loading and fails. In contrast, a conventional projectile penetrator 20 such as seen in FIG. 3, upon initial impact with the target, will produce a series of non-reinforcing stress waves through the target as shown in FIG. 10.

Figure 7:
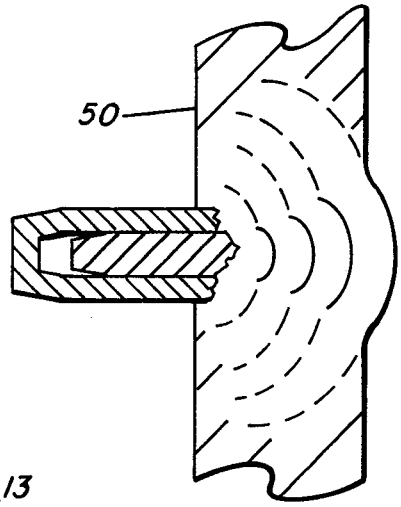
FIG. 7 is a longitudinal view schematically illustrating the continuation of the penetration process.

When the projectile of this invention is fired from a gun, the expanding propellant gases exert a positive force on the projectile base, which keeps the rod penetrator core 11 set-back to the rear of the carrier 11 in the position shown by FIG. 1. Upon target impact, the thin aerodynamic windshield 13 is readily disintegrated. As the beveled leading edge 15 makes contact with the target 50, the projectile is rapidly decelerated during the initial penetration process and the abrupt arresting of momentum causes the higher density rod penetrator core 12 to be moved violently forward to add a second generation of impact stresses as suggested in FIG. 7. The stress field initiated by the beveled leading edge 15 of the carrier 11 is supplemented by a second series of shock loading stresses concentrated in the same field, in the manner of a "one-two punch" which is far more damaging than a single punch by either penetration mechanism acting alone.

Figure 2:
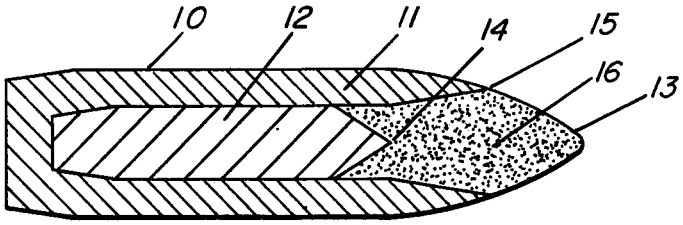
FIG. 2 is a cross-sectional view of a second embodiment of this invention.

FIG. 2 is similar in geometry to the projectile of FIG. 1, except that this embodiment has been adapted to include an incendiary material 16 located inside the windscreen 13 and enclosed by the rod penetrator core 12 and the forward section of the carrier 11. It will be recognized that either embodiment, FIG. 1 or FIG. 2, could readily include a tracer in the base of the carrier body as this is easily within the state-of-the-art.

Figure 3:
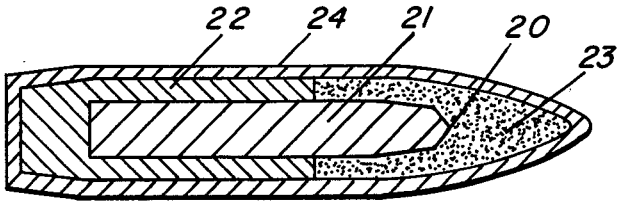
FIG. 3 PRIOR ART
FIG. 3 is a cross-sectional view of a current non-saboted high density core .50 cal projectile.

FIG. 3 depicts the current .50 caliber conventional anti-armor projectile 20. It consists of a high density material core 21 placed within an aluminum base the carrier 22. The forward section of the projectile uses either a filler material such as a plaster or an incendiary material 23. The entire structure is encased by a thin gilding metal envelope 24. In contrast to my inventive structure, the only element of projectile 20 involved in the target penetration process is the core 21.

Figure 4:
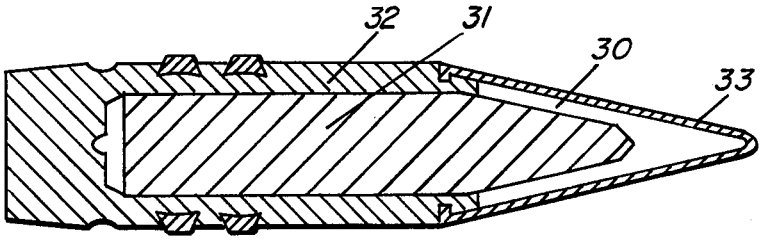
FIG. 4 PRIOR ART
FIG. 4 is a cross-sectional view of the current Air Force GAU-8 30 mm high density core projectile.

It is intended that my invention be utilized in a wide range of guns, from handguns through larger caliber guns. However, the same penetration phenomena discussed above will apply to the geometric envelope of each specific projectile size or configuration. For example, although the caliber .45 has a short projectile length to diameter, it is primarily intended for personnel who may be wearing armor vest type clothing. By contrast, the 30 mm GAU-8 projectile envelope, FIG. 4, allows for a much greater projectile length to diameter, which then provides for a longer rod core, giving more mass and a higher ballistic coefficient for target penetration. This is entirely appropriate as the larger caliber projectiles are intended for anti-materiel purposes. The present GAU-8 anti-armor projectile 30 consists of a high density materiel rod core 31 surrounded by an aluminum materiel 32 which forms the projectile configuration. Upon target impact, the aluminum "windscreen" 33 is readily broken up leaving the high density rod 31 to penetrate the target. This action produces only a single stage penetration stress pattern and is not capable of defeating heavy armor plate systems.

Figure 5:
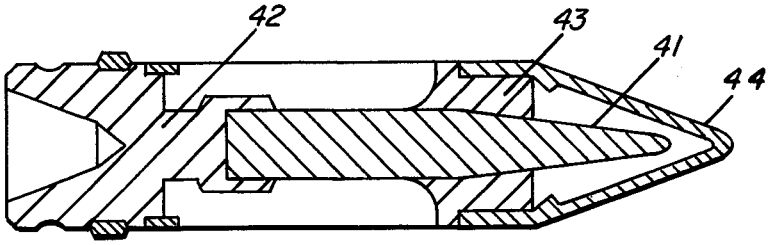
FIG. 5 PRIOR ART
FIG. 5 is a cross-sectional view of the current Armor Piercing Discarding Sabot (APDS) Projectile as used in gun systems like the 20 mm Phalanx.

FIG. 5 represents a form of the current discarding sabot projectile as patented by Feldman (U.S. Pat. Nos. 3,714,900 and 3,905,299). Note that sabot elements 42, 43, and the windshield 44 must be discarded after leaving the gun muzzle in order to allow the sub-caliber core 41 to continue toward the target without the considerable ballistic drag which would result from failure to discard such components. Besides being expensive to produce sabot subassembly components instead of a single unitary sabot, there is a relatively greater risk of compromising performance in multiple-component sabots. Thus, the sabot must totally discard all its parts in a matter of micro-seconds, immediately when the round exits the gun muzzle, and without any angular or lateral non-symmetrical forces applied to the core 41 such as would disrupt its uninhibited trajectory even slightly. Any such aerodynamic perturbations during discard could cause the penetrator to miss the distant target or to alter its angularity at impact, which degrades its penetration effectiveness away from optimum design conditions. In contrast, the projectile of this invention has no discarding dead-weight, high drag masses or parasitic elements which do not contribute to the penetration process, and its accuracy is not compromised by highly sensitive and unreliable sabot-discarding mechanisms.

Figure 8:
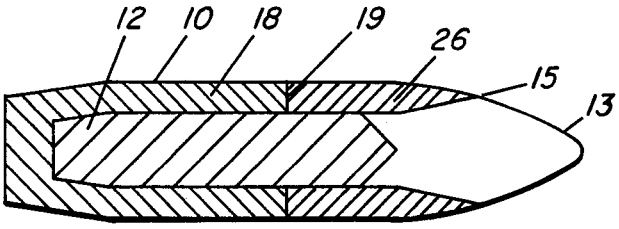
FIG. 8 is a cross-sectional view of a third embodiment of this invention.

Referring to FIG. 8, a further modification of the invention is seen for use where gun recoil and barrel forces are limited within a narrow performance force envelope, and excessive impulse loading could destroy the weapon by using higher mass projectiles than what the weapon is designed to fire. To accelerate a projectile for armor piercing capability without exceeding gun total impulse design limitations, a decrease in projectile mass may be necessary. In the modification of FIG. 8, this is accomplished by forming carrier element 11 in two parts instead of a single unitary mass as shown in FIG. 1. The FIG. 8 modification shows carrier 11 comprising two structurally joined positions 26 and 18 made from two dissimilar materials. Forward portion 26 formed with forward sharply beveled leading edge 15 is made of undeformable and high-hardness material such as high-strength steel, while aft or rear portion 18 is made of lighter weight material such as aluminum, reinforced plastic or strong and lightweight composite fiberglass or filament laminates of metallic, ceramic and non-metallic materials. Elements 26 and 18 are securely joined at their interface 19 by any suitable means such as screw-threads, various high-strength epoxy based adhesives, or any other assembly techniques known to the prior art and widely used in industry. When thus joined, elements 26 and 18 form a single solid, substantially cylindrical hollow mass which is dimensioned so as to grasp snugly the heavier and higher density penetration core element 12 in the same manner that carrier 11 embraces and retains element 12 in FIG. 1.

Figure 9:
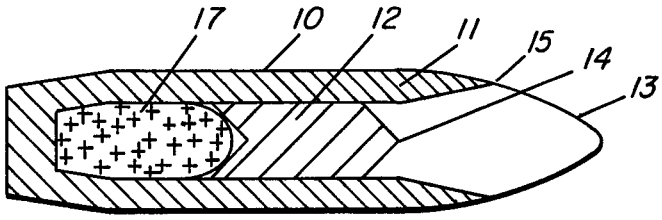
FIG. 9 is a cross-sectional view of a fourth embodiment of this invention.

FIG. 9 shows an additional modification of the inventive structure in this case, wherein rod core 12 in FIG. 1, instead of being a simple homogenious mass, is composed of plural elements 12 and 17. Forward element 12 has a generally conical or pointed nose 14 and is made from high density, non-deforming material which may coincide with the materials discussed above for FIG. 1.

Element 17 is of different material than element 12, and may be heavier or lighter, depending upon the combat needs which the round is designed to fulfill. Thus, for example, item 17 may be an elongate slug of material heavier than item 12, and positioned so as to add greater impact force to mass 12 at the time projectile 10 strikes a target surface. Elongate mass 12 in FIG. 9 is provided with a depression such as a spherical or conical cavity at its aft or base end opposite from nose 14, mass 17 has either a spherical or conical forward end portion which nests or bears against the aft cavity in mass 12 as shown in FIG. 17 in a symmetrical pattern of surface bearing contact. Mass 17 may, alternatively, comprise a crushable plastic, composite, or metallic capsule containing a material. The precise composition of which will depend upon the combat need to be served. Thus, mass 17 may illustratively comprise a chemical agent, an explosive material, or an incendiary material which scatters within a crew-compartment or the like after penetration is achieved by carrier 11 and penetrator 12. Also, in all embodiments of this invention, the cavity behind nose windscreen 13 may be used for loading incendiary or other useful material.

I claim:

1. A composite projectile for use in the penetration of armor protected targets when fired from a gun bore consisting of:

an elongated cylindrical rigid hollow carrier having a closed aft end portion and an open forward portion provided with a first end, said first end of said carrier provided with a sharp annular non-deformable leading edge of extreme harness, said carrier having an outer diameter fitting in close uniform direct surface contact with said gun bore when said carrier is fired at a target, said aft end portion of lightweight material, and said forward portion of denser material than said aft material, an elongated cylindrical penetrator core of high density material for the penetration of armor when said core impacts said target, said core carried in said hollow carrier, said core having a cylindrical body provided with a forward conical end terminating in a point, and an aft end in separable contact with said aft end of said carrier on initial firing and then separating from said aft end of said carrier on impact with said target, said core fitting in telescopically slidable relation within said carrier, said core having a forward pointed end situated aft of said forward end of said carrier when said aft end of said core is in contact with said closed end of said carrier, a thin-walled hollow fairing in the form of an ogive secured to said forward end of said carrier for the reduction of aerodynamic drag of said projectile during flight.

* * * * *